US009302155B2

(12) United States Patent
Hixenbaugh et al.

(10) Patent No.: US 9,302,155 B2
(45) Date of Patent: Apr. 5, 2016

(54) DIMPLE PATTERNS WITH SURFACE TEXTURE FOR GOLF BALLS

(71) Applicant: Acushnet Company, Fairhaven, MA (US)

(72) Inventors: Chris Hixenbaugh, Dartmouth, MA (US); Nicholas M. Nardacci, Marion, MA (US); Michael R. Madson, Wrentham, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 14/476,843

(22) Filed: Sep. 4, 2014

(65) Prior Publication Data

US 2016/0067552 A1 Mar. 10, 2016

(51) Int. Cl.
*A63B 37/14* (2006.01)
*A63B 37/00* (2006.01)

(52) U.S. Cl.
CPC ..... *A63B 37/0012* (2013.01); *A63B 37/0006* (2013.01); *A63B 37/0011* (2013.01); *A63B 37/0015* (2013.01); *A63B 37/0018* (2013.01); *A63B 37/0021* (2013.01)

(58) Field of Classification Search
CPC ..... A63B 37/0012; A63B 37/0006; A63B 37/0018; A63B 37/0021; A63B 37/0004; A63B 37/0005; A63B 37/0011; A63B 37/0015; A63B 37/14
See application file for complete search history.

(56) References Cited

U.S. PATENT DOCUMENTS

| | | | | |
|---|---|---|---|---|
| 4,284,276 | A * | 8/1981 | Worst | A63B 37/0004 40/327 |
| 4,787,638 | A | 11/1988 | Kobayashi | |
| 5,547,197 | A * | 8/1996 | Pocklington | A63B 37/0004 473/384 |
| 5,879,245 | A * | 3/1999 | Hwang | A63B 37/0004 473/384 |
| 6,176,793 | B1 * | 1/2001 | Sullivan | A63B 37/0004 473/351 |
| 6,569,038 | B2 * | 5/2003 | Sullivan | A63B 37/0004 473/378 |
| 7,226,369 | B2 | 6/2007 | Aoyama et al. | |
| 7,250,012 | B1 * | 7/2007 | Simonds | A63B 37/0004 473/383 |
| 7,722,484 | B2 | 5/2010 | Morgan et al. | |
| 7,867,109 | B2 | 1/2011 | Sullivan et al. | |
| 8,329,081 | B2 | 12/2012 | Morgan et al. | |
| 2001/0019974 | A1 * | 9/2001 | Hanada | A63B 37/0004 473/378 |
| 2003/0211903 | A1 * | 11/2003 | Hanada | A63B 37/0004 473/378 |
| 2004/0127306 | A1 * | 7/2004 | Sato | A63B 37/0004 473/383 |
| 2009/0280929 | A1 * | 11/2009 | Doot | A63B 37/0004 473/384 |
| 2012/0165130 | A1 | 6/2012 | Madson et al. | |
| 2012/0301617 | A1 | 11/2012 | Fitchett et al. | |
| 2013/0072325 | A1 | 3/2013 | Madson et al. | |
| 2013/0168896 | A1 * | 7/2013 | Tutmark | A63B 45/00 264/219 |

* cited by examiner

*Primary Examiner* — John E Simms, Jr.

(57) ABSTRACT

The present invention provides a golf ball having an outer surface comprising a plurality of dimples covering greater than 70 percent of the outer surface, wherein at least 20 percent of the dimples incorporate directional surface texturing therein. The directional surface texturing preferably comprises substantially parallel channels or protrusions formed within the dimples.

14 Claims, 8 Drawing Sheets

DIMPLE PATTERNS WITH SURFACE TEXTURE FOR GOLF BALLS

FIELD OF THE INVENTION

This invention relates to golf balls, particularly to golf balls possessing unique dimple patterns including surface texture. More particularly, the invention relates to golf balls having dimples arranged on the outer surface for primary aerodynamic behavior and flight characteristics and surface texture for secondary aerodynamic behavior.

BACKGROUND OF THE INVENTION

Historically, dimple patterns for golf balls have had a variety of geometric shapes, patterns, and configurations. Primarily, patterns are laid out in order to provide desired performance characteristics based on the particular ball construction, material attributes, and player characteristics influencing the ball's initial launch angle and spin conditions. Therefore, dimple pattern development is a secondary design step that is used to achieve the appropriate aerodynamic behavior, thereby tailoring ball flight characteristics and performance attributes.

Aerodynamic forces generated by a ball in flight are a result of its velocity and spin. These forces can be represented by a lift force and a drag force. Lift force is perpendicular to the direction of flight and is a result of air velocity differences above and below the rotating ball. This phenomenon is attributed to Magnus, who described it in 1853 after studying the aerodynamic forces on spinning spheres and cylinders, and is described by Bernoulli's Equation, a simplification of the first law of thermodynamics. Bernoulli's equation relates pressure and velocity where pressure is inversely proportional to the square of velocity. The velocity differential, due to faster moving air on top and slower moving air on the bottom created by the ball's spin, results in lower air pressure on top and an upward directed force on the ball.

Drag is opposite to the direction of flight and orthogonal to lift. The overall drag force on a ball is attributed pressure drag and viscous or skin friction drag. A sphere is a bluff body, which is a somewhat inefficient aerodynamic shape. As a result, the accelerating flow field around the ball causes a large pressure differential with high-pressure forward and low-pressure behind the ball. The low pressure area behind the ball is also known as the wake. In order to minimize pressure drag, dimples provide a means to energize the flow field and delay the separation of flow, or reduce the wake region behind the ball. Skin friction is a viscous effect residing close to the surface of the ball within the boundary layer.

The industry has seen many efforts to maximize the aerodynamic efficiency of golf balls, through dimple distribution and other methods, though they are closely controlled by golf's national governing body, the United States Golf Association (U.S.G.A.). One U.S.G.A. requirement is that golf balls have aerodynamic symmetry. Aerodynamic symmetry allows the ball to fly with a very small amount of variation no matter how the golf ball is oriented when tested. Preferably, dimples cover the maximum surface area of the golf ball without detrimentally affecting the aerodynamic symmetry of the golf ball and the ability of the ball to roll smoothly.

In attempts to improve aerodynamic symmetry, many dimple patterns have been developed based on geometric shapes. These may include circles, hexagons, triangles, and the like. Other dimple patterns are based in general on the five Platonic Solids including icosahedron, dodecahedron, octahedron, cube, or tetrahedron. Yet other dimple patterns are based on the thirteen Archimedian Solids, such as the small icosidodecahedron, rhomicosidodecahedron, small rhombicuboctahedron, snub cube, snub dodecahedron, or truncated icosahedron. Furthermore, other dimple patterns are based on hexagonal dipyramids. Dimple properties such as number, shape, size, volume, edge angles and arrangement are often manipulated in an attempt to generate a golf ball that has improved aerodynamic properties.

Furthermore, secondary surface texture has been suggested to augment the dimples and further refine the aerodynamic properties of the ball. In fact, early golfers found that the feathery golf balls flew better after being played for a while. They then began to purposely roughen the surface to created improved aerodynamic properties.

Similarly, U.S. Pat. No. 4,787,638 to Kobayashi discloses a golf ball with a plurality of first dimples arranged substantially uniformly on the outer surface of the ball. The ball also includes a plurality of indentations which are smaller than the dimples and are also arranged substantially uniformly on the outer surface and inside the surfaces of the dimples. The indentations may be formed by grit blasting. Likewise, U.S. Publication No. 2012-0301617 teaches essentially the same micro surface roughness over the surface of the golf ball to affect aerodynamic properties of the ball.

U.S. Pat. No. 8,329,081 to Morgan discloses a method of forming a golf ball with secondary surface texture created on the fret areas of a ball. The secondary surface texture is created on the golf ball hob prior to the primary dimples being formed into the hob. When the dimples are formed, they largely obliterate the secondary surface texture except for the fret area and the perimeter of the dimples.

U.S. Pat. No. 6,569,038, to Sullivan discloses a ball having dimples with structures therein to energize or agitate the airflow over the dimpled surface to increase the aerodynamic performance of the ball. These structures include sub-dimples and radiating convex or concave arms emanating from the center of the dimple.

SUMMARY OF THE INVENTION

The present invention is directed to a golf ball having an outer surface comprising a plurality of dimples incorporating directions surface texturing. Preferably, the dimples on the golf ball cover greater than 70 percent of the outer surface and at least 20 percent of the dimples incorporate directional surface texturing therein. More preferably, the outer surface of the golf ball comprises less than 400 dimples and at least 50 percent of the dimples incorporate directional surface texturing therein. Most preferably, the outer surface of the golf ball comprises less than 360 dimples and all of the dimples incorporate directional surface texturing therein.

Preferably, the directional surface texturing is comprised of linear arrangements within the dimples. The linear arrangements are preferably a plurality of linear channels that are substantially parallel within the dimple. In another embodiment, the linear arrangements are a plurality of linear protrusions that are substantially parallel within the dimple.

In a preferred embodiment, the directional surface texturing is comprised of linear arrangements within a dimple that are disposed at an angle of between about 10 and 90 degrees with respect to the linear arrangements of an adjacent dimple. More preferably, the Linear arrangements are arranged at an angle of between about 30 and 90 degrees with respect to an adjacent dimple. In another preferred embodiment, there are no dimples on the ball that have an adjacent dimple with parallel linear arrangements.

It is preferred that the golf ball be comprised of a plurality of dimples incorporating linear channels or linear protrusions that have a maximum channel depth or height of less than ¼ of the dimple depth they are in. Moreover, the linear channels or protrusions have a length that is at least 5 times the channel or protrusion width. The channel or protrusion width can be substantially similar to depth or height, but is preferably at least 2 times greater than the depth or height. Also, the channels or protrusions are spaced apart such that the length between adjacent channels or protrusions is at least 2 times the width. The directional surface texturing preferably has a cross-sectional shape that is V-shaped, U-shaped, rectangular or other partial polygonal shape or any continuous curve defined by superposed curves such as those described in U.S. Publication No. 2012-0165130, which is incorporated by reference herein in its entirety.

BRIEF DESCRIPTION OF THE DRAWINGS

In the accompanying drawings, which form a part of the specification and are to be read in conjunction therewith, and in which like reference numerals are used to indicate like parts in the various views.

DETAILED DESCRIPTION

Figure 1:
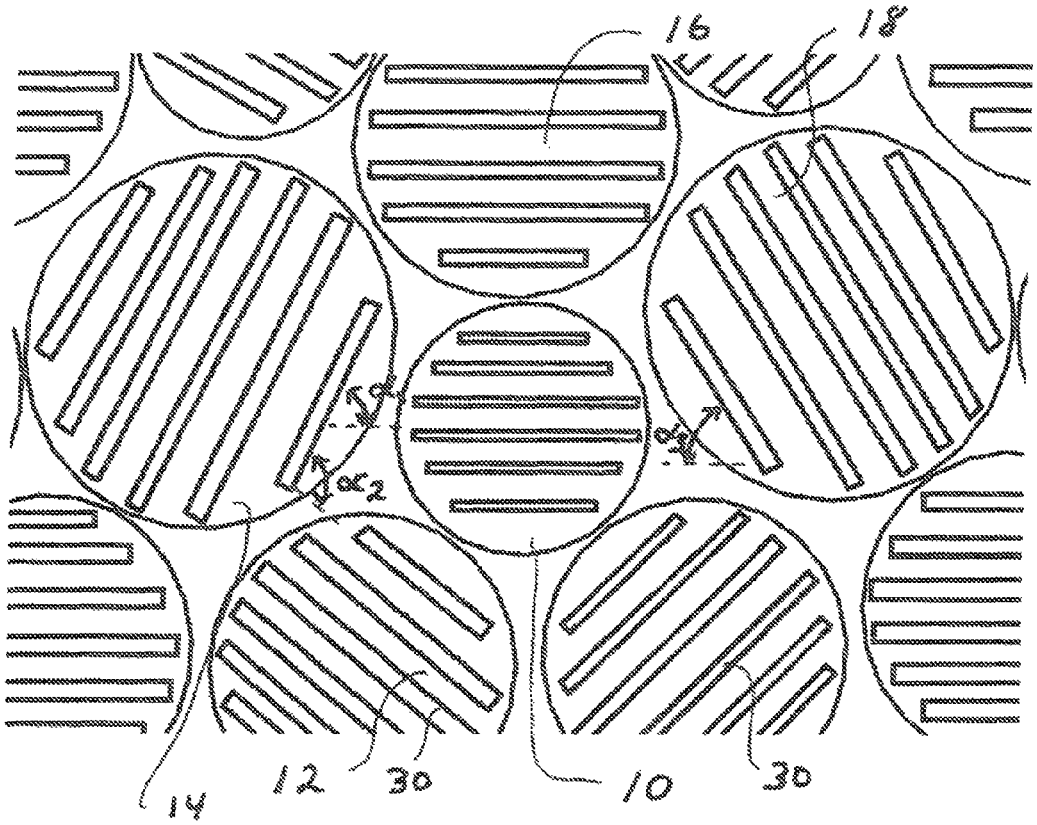
FIG. 1 illustrates a portion of a golf ball with directional surface texturing according to the present invention.

The present invention is directed to golf ball with improved dimples. The aerodynamic characteristics of a golf ball are largely dependent on the dimples of a golf ball and the way that the dimples are arrange. Golf balls typically include 250 to 450 dimples on the outer surface that range from about 0.08 to 0.2 inches in diameter, if circular. The way that these dimples are arranged over the outer surface, the shapes of the dimples and the edge angles of the dimples are all important to the overall flight performance of the golf ball. In FIG. 1, a plurality of dimples having directional surface texturing are disclosed. The dimples 10 through 20, for example, are adjacent dimples and have different dimple diameters. However, all of the dimples shown include a plurality of linear channels 30 therein.

Preferably, a golf ball according to the present invention has an outer surface comprising a plurality of dimples covering greater than 70 percent of the outer surface and at least 20 percent of the dimples incorporate directional surface texturing. Directional surface texturing is defined as a plurality of indentations or protrusions that form aligned arrangements within the dimple.

The outer surface of the golf ball preferably comprises less than 400 dimples of different sizes and, more preferably, at least 5 different sizes. In a preferred embodiment, at least 50 percent of the dimples incorporate directional surface texturing such as the linear channels 30 therein. The linear channels 30 are substantially parallel within the dimple. Preferably, there are between 2 and 6 linear channels within the dimples. Although FIG. 1 shows each of the dimples containing 6 linear channels, it is contemplated that smaller diameter dimples are likely to have less linear channels than larger diameter dimples. For example, in a preferred embodiment, a dimple having a diameter of less than 0.12 inch can have between 2 and 5 linear channels and a dimple having a diameter of 0.12 to 0.2 inch can have between 5 and 8 linear channels.

In a preferred embodiment of the invention, the outer surface of the golf ball comprises less than 360 dimples and all of the dimples incorporate directional surface texturing made up of substantially linear arrangements that are aligned. The linear arrangements, like the linear channels 30 disclosed in FIG. 1, are preferably substantially parallel to each other and extend across a substantial portion of the dimple. While the linear channels 30 shown in FIG. 1 are parallel within each dimple, they are at offset angles cc with respect to adjacent dimples. The linear channels 30 within a dimple are disposed at angles of between about 10 and 90 degrees with respect to the linear channels 30 of an adjacent dimple. For example, dimple 10 includes linear channels that are disposed at an angle $\alpha$ of between 10 and 90 degrees with respect to each of the adjacent dimples 12, 14, 18 and 20. As shown, the linear channel angles $\alpha_1$ and $\alpha_2$ are about 60 degrees and $\alpha_3$ is about 90 degrees. Preferably, the linear channels 30 are arranged at an angle $\alpha$ of between about 30 and 90 degrees with respect to most of the adjacent dimples. In some arrangements, the golf ball can be designed such that no dimple on the ball has an adjacent dimple with parallel linear arrangements.

Figure 2:
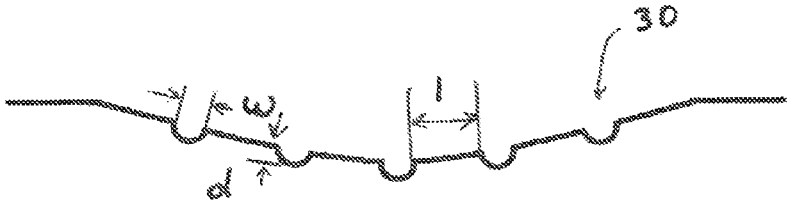
FIG. 2 illustrates a cross-sectional view of a dimple incorporating directional surface texturing according to the present invention.
Figure 7:
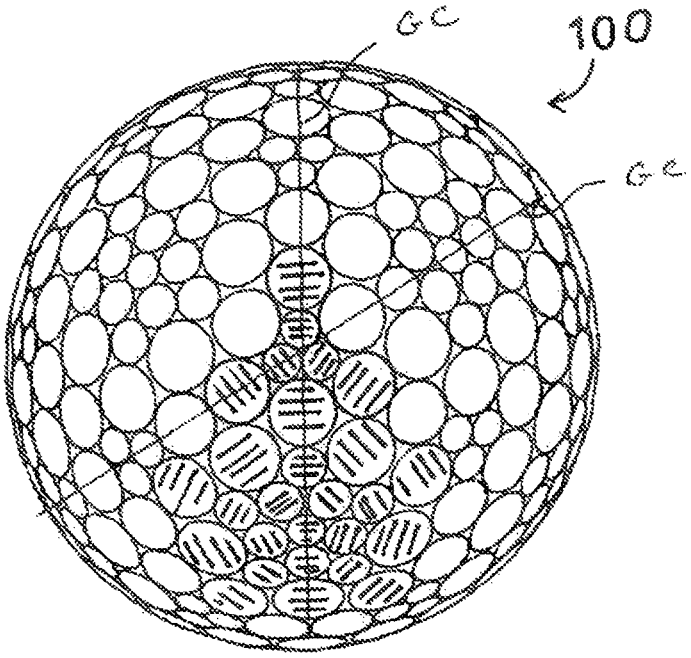
FIG. 7 illustrates a golf ball formed according to the present invention.

Referring to FIG. 2, a cross-section of a dimple is shown. The dimple depth, volume and edge angles of the dimples are measured as set forth in U.S. Pat. No. 7,226,369, as shown in FIG. 7 and discussed in col. 11, line 64 through, col. 12, line 46, which is incorporated by reference herein. The surface texturing is relatively small in comparison to the dimple and intended as a secondary aerodynamic function as discuss below. For example, preferably, the linear channels 30 have a maximum channel depth d of less than ¼ of a dimple depth. Linear protrusions within a dimple would be the inverse of the linear channels 30 shown. More preferably, the directional surface texturing depth (or protrusion height, if reversed) is less than about 0.002 inches. Also, the directional surface texturing has a width w, such as the channel width shown, that is equal to or greater than the depth and preferably greater than about twice the depth d. Further, the length between the directional surface texturing, shown as l, is preferably equal to or greater than the width w. Preferably, the length l is greater than twice the width w. Where FIG. 2 discloses a substantially U-shaped cross-section, it is preferred that the cross-section of the channels 30 be V-shaped, U-shaped, rectangular or other partial polygonal shape or any continuous curve defined by superposed curves such as those described in U.S. Publication No. 2012-0165130.

Further, the directional surface texturing is substantially elongated. The lengths of the directional surface texturing elements are preferably greater than 5 times the widths and extend substantially across the dimples. For example, the lengths of the linear channels 30 are preferably greater than 5 times the channel widths w and extend substantially across the dimples as shown. If a dimple is about 0.15 inches, the directional surface texturing in the center of the dimple preferably has a length of at least 0.1 inch, and more preferably, about 0.11-0.13 inch. The same directional surface texturing preferably has a width of less than about 0.02. Similarly, smaller dimples having a diameter of about 0.11 inch may have directional surface texturing with a length of about 0.08 to 0.09 inch. Preferably, the width of the directional surface texturing will be approximately the same as the surface texturing in the larger dimples. The table below is an example of a preferred dimple pattern incorporating linear channels as the directional surface texturing.

TABLE 1

| Dimple Diameter (in) | Number of Dimples | Number of Channels/Dimple | Channel Width (in) | Channel Depth (in) |
|---|---|---|---|---|
| 0.115 | 12 | 4 | 0.01 | 0.002 |
| 0.155 | 20 | 5 | 0.01 | 0.002 |
| 0.160 | 40 | 5 | 0.01 | 0.002 |
| 0.165 | 50 | 5 | 0.01 | 0.002 |
| 0.170 | 60 | 5 | 0.01 | 0.002 |
| 0.175 | 80 | 6 | 0.01 | 0.002 |
| 0.180 | 70 | 6 | 0.01 | 0.002 |

The present invention also provides a method for arranging dimples with directional surface texturing on a golf ball surface. The method includes creating sections on the surface of a golf ball. Preferably, the sections are polyhedrons or portions thereof and then filling the sections with dimples incorporating directional surface texturing. Each of the sections can contain a different arrangement of the directional surface texturing. For example, as discussed with FIG. 1 above, the dimples 10-20 all contain directional surface texturing that is oriented at an angle with respect to an adjacent dimple. This arrangement of the directional surface texturing provides that the ball has a uniform secondary aerodynamic characteristic regardless of the direction the ball is oriented.

Referring to FIGS. 3-12, a dimple pattern can be formed by choosing control points of a polyhedron, connecting the control points with a non-straight sketch line, patterning the sketch line in a first manner to generate an irregular domain, optionally patterning the sketch line in a second manner to create an additional irregular domain, packing the irregular domain(s) with dimples, and tessellating the irregular domain(s) to cover the surface of the golf ball in a uniform pattern. The control points can include the center of a polyhedral face, a vertex of the polyhedron, a midpoint or other point on an edge of the polyhedron, and others. The method ensures that the symmetry of the underlying polyhedron is preserved while minimizing or eliminating great circles due to parting lines from the molding process.

Figure 3:
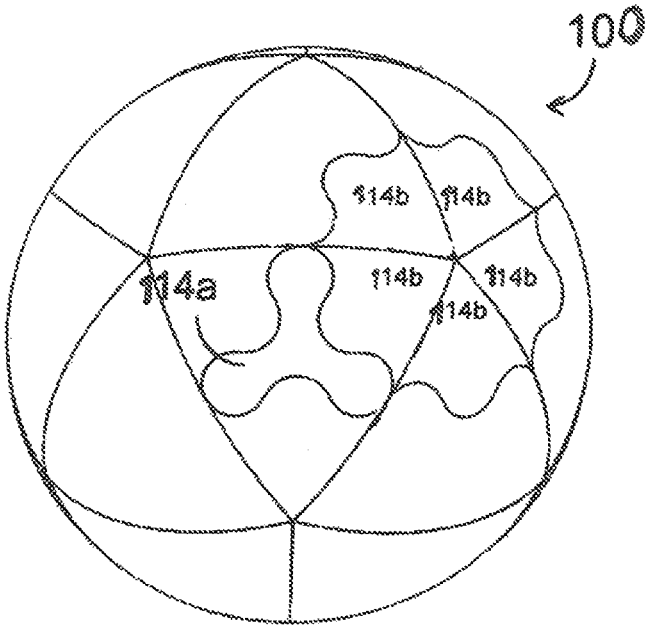
FIG. 3 illustrates a first domain and a second domain formed in an icosahedron face projected on a sphere.
Figure 4:
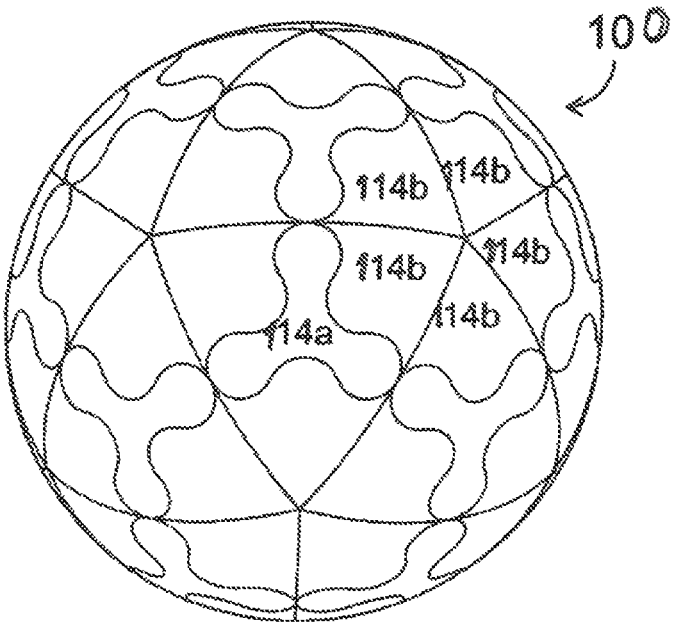
FIG. 4 illustrates the domains of FIG. 3 tessellated to cover the surface of a sphere.

Referring to FIGS. 3-7, a golf ball outer surface can be divided into equal sections by the projections of an icosahedron. Each icosahedron can then be divided by a midpoint to midpoint method, for example, to yield two domains that are tessellate to cover the surface of golf ball 100 as shown in FIGS. 3 and 4. The two domains are shown as 114*a* and 114*b*. The method of forming the different sections and then tessellating them over the surface of a golf ball to create different dimple patterns formed from such sections is set forth in U.S. application Ser. No. 13/675,041, which published as Publication No. 2013-0072325 on Mar. 21, 2013, and which is incorporated by reference in its entirety herein.

Figure 5:
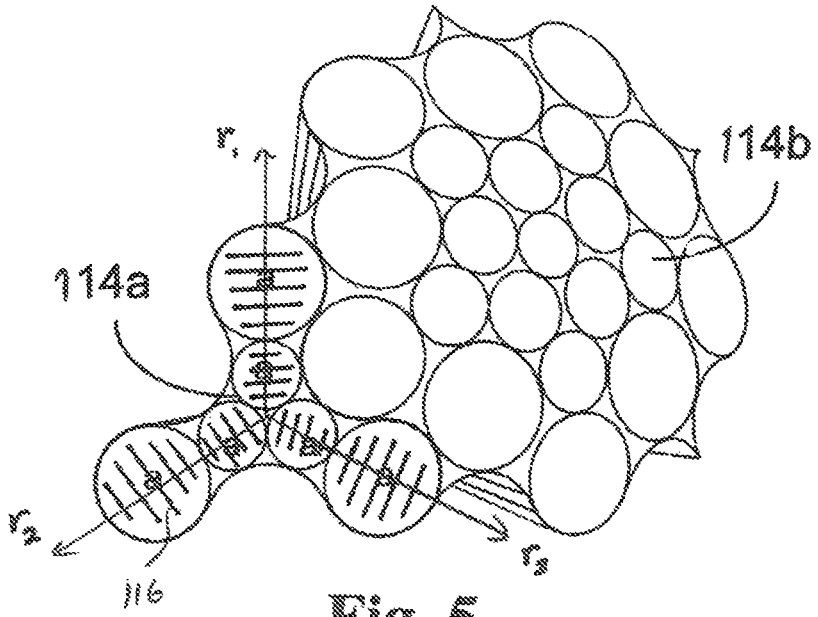
FIG. 5 illustrates a first portion of a golf ball dimple pattern formed according to the present invention.
Figure 6:
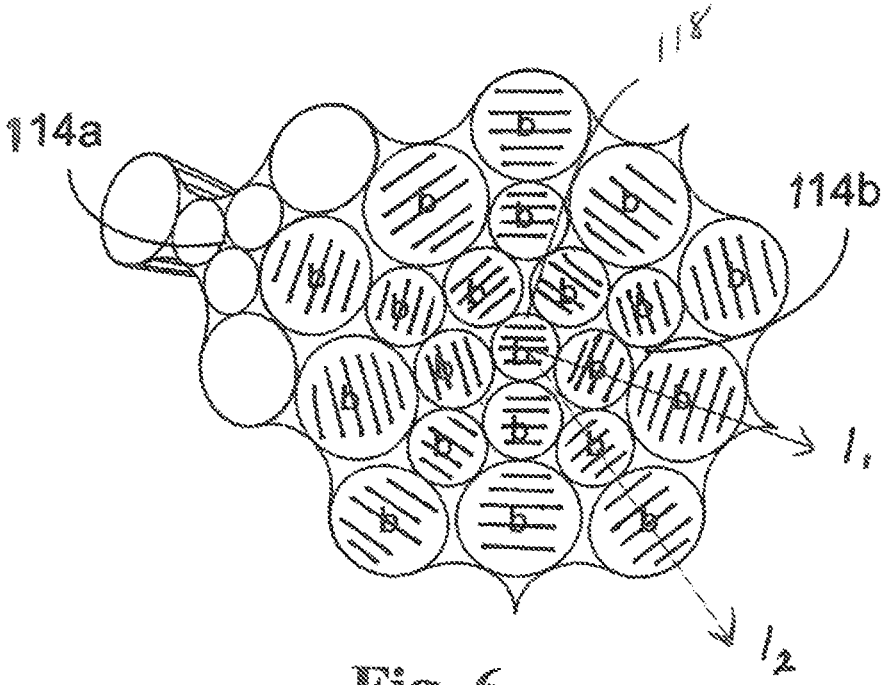
FIG. 6 illustrates a second portion of a golf ball dimple pattern formed according to the present invention.

Referring to FIGS. 5 and 6, the sections 114*a* and 114*b* are then filled with directional surface texturing. Elongated, linear protrusions 116 are formed within each dimple such that within the dimple, they are substantially parallel. The protrusions preferably have similar dimensions to the channels discussed above.

In a first section, set forth in FIG. 5, the directional surface texturing can be formed by selecting a midpoint of the section and then forming the linear elements perpendicular to the radii $r_1$-$r_3$ that emanate from the center. Similarly, in FIG. 6, the directional surface texturing is formed by forming protrusions that are perpendicular to the lines $l_1$ and $l_2$ emanating from the center dimple 118. In this manner, as shown in FIG. 7, each of the dimples in the sections will have an adjacent dimple with directional surface texturing at an angle between 10 and 90 degrees with respect thereto. This pattern will also form a plurality of great circles GC over the surface of the ball that intersect dimples incorporating directional surface texturing oriented perpendicular thereto.

Figure 8:
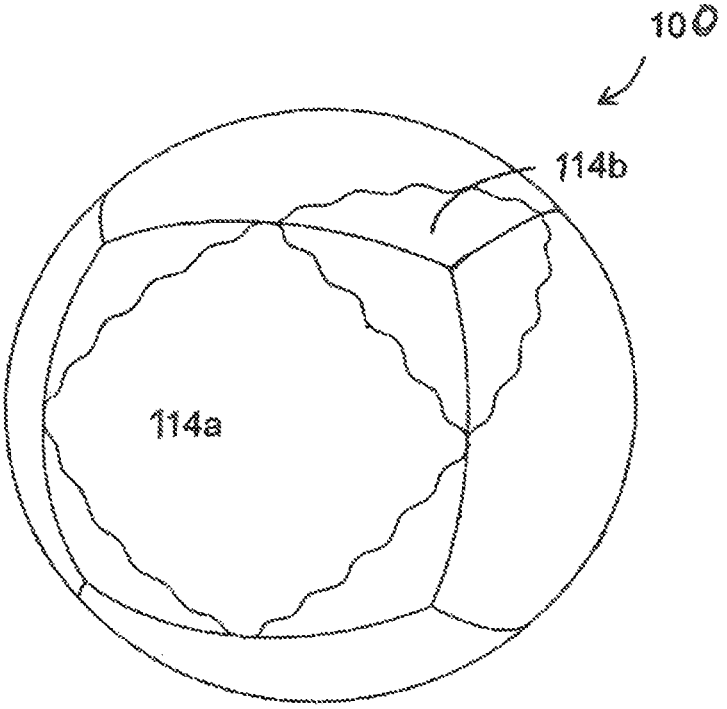
FIG. 8 illustrates a first domain and a second domain formed in a cube face projected on a sphere.
Figure 9:
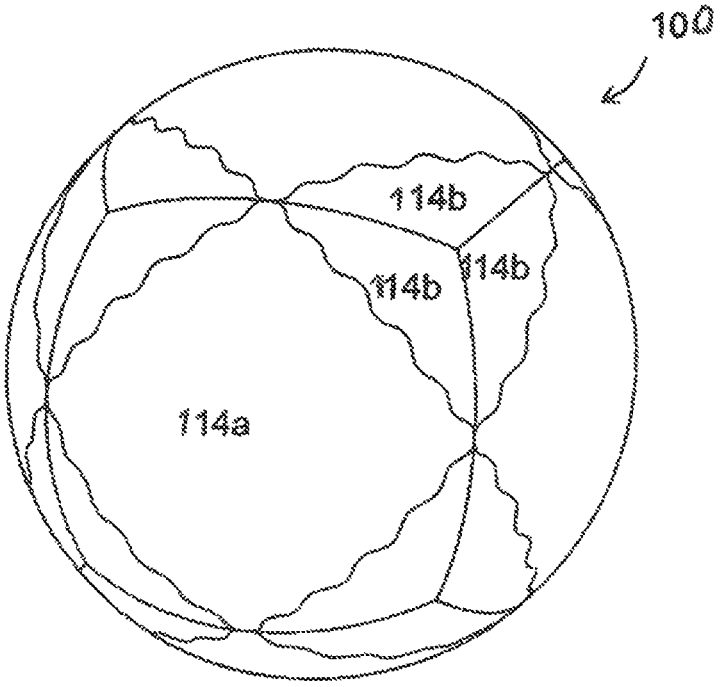
FIG. 9 illustrates the domains of FIG. 8 tessellated to cover the surface of a sphere.

Referring to FIGS. 8-12, a golf ball outer surface can be divided into equal sections by the projections of a cube. Each cube can then be divided by a midpoint to midpoint method, for example, to yield two domains that are tessellate to cover the surface of golf ball 100 as shown in FIGS. 8 and 9. The two domains are shown as 114*a* and 114*b*. Again, the method of forming the different sections and then tessellating them over the surface of a golf ball to create different dimple patterns formed from section is set forth in U.S. application Ser. No. 13/675,041.

Figure 10:
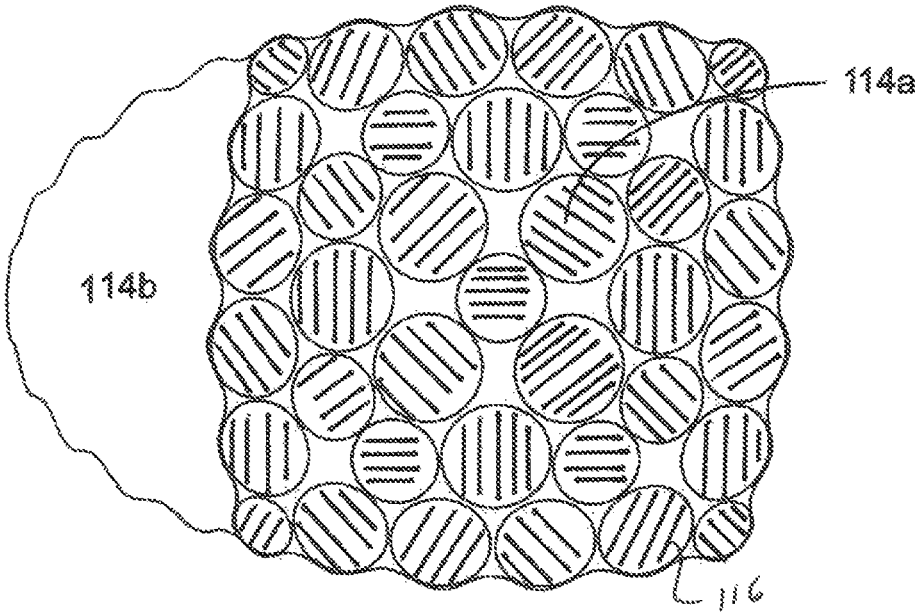
FIG. 10 illustrates a first portion of a golf ball dimple pattern formed according to the present invention.
Figure 11:
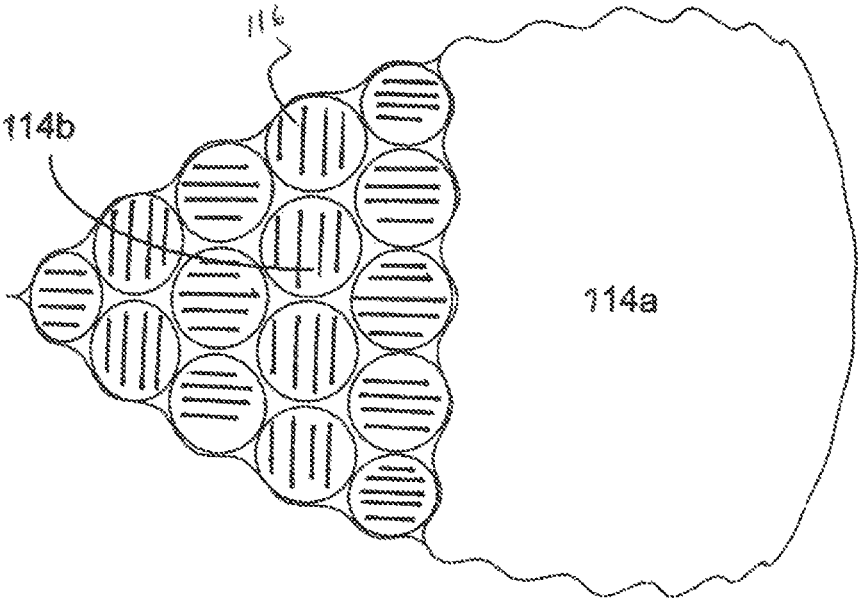
FIG. 11 illustrates a second portion of a golf ball dimple pattern formed according to the present invention.

Referring to FIGS. 10 and 11, the sections 114*a* and 114*b* are then filled with directional surface texturing 116. Elongated, linear protrusions 116 are formed within each dimple such that within the dimple, they are substantially parallel.

Figure 12:
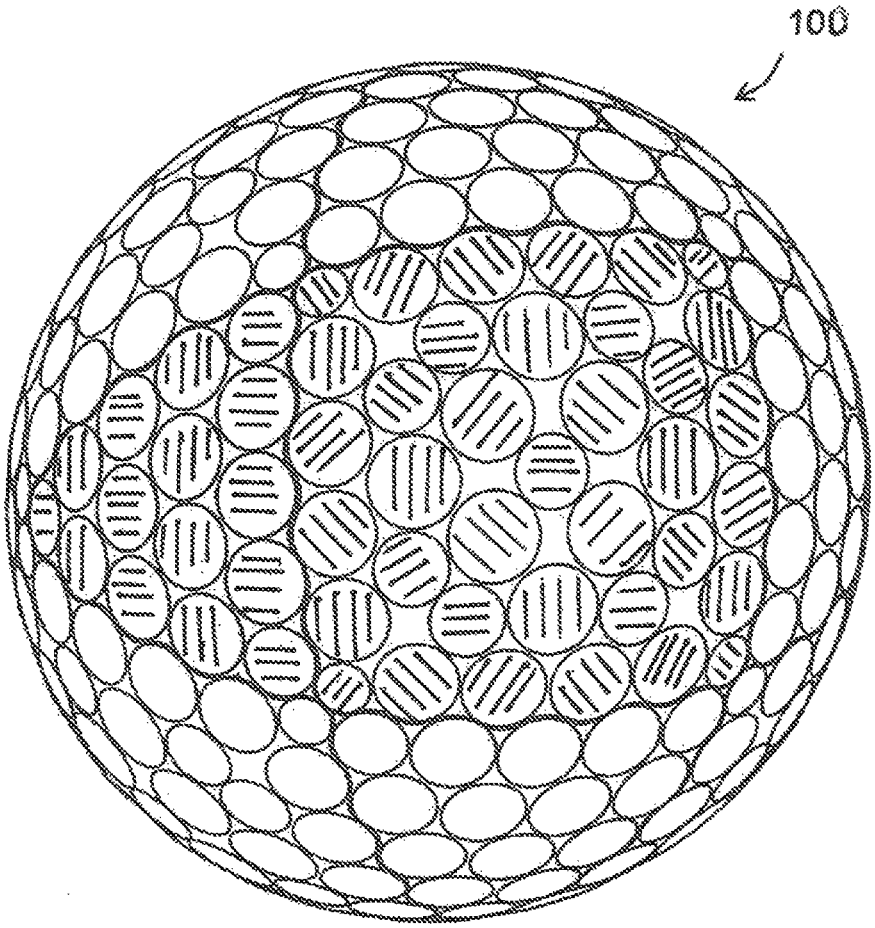
FIG. 12 illustrates a golf ball formed according to the present invention.

In a first section, set forth in FIG. 10, the directional surface texturing 116 can be formed by forming the linear elements 116 such that they are oriented at about 45 degree angles with respect to the directional surface texturing in an adjacent dimple. Similarly, in FIG. 11, the directional surface texturing 116 is formed by forming linear elements that are substantially perpendicular with respect to those in an adjacent dimple. As shown in FIG. 12, this type of arrangement results in an overall ball that has no great circles that intersect dimples having directional surface texturing that is perpendicular to the great circle. However, every dimple on the ball 100 still has an adjacent dimple with directional surface texturing at an angle of about 30 to 90 degrees relative thereto.

Furthermore, the present invention also contemplates an improvement in the aerodynamic characteristics of the golf ball. In particular, it is an object of the invention to improve the aerodynamics at low Reynolds Numbers and low Spin Ratios with the directional surface texturing. The aerodynamic properties of a golf ball and improvements in those properties are specifically discussed in detail in U.S. Pat. No. 7,226,369, and particularly in col. 4-col. 10 and col. 12-col. 17, which is incorporated by reference herein in its entirety. More particularly, the golf ball dimple pattern preferably comprises less than 370 dimples and more preferably less than 360 dimples covering over 75% of the outer surface of the ball and containing directional surface texturing within each dimple. More particularly, the golf ball preferably has a coefficient of lift at a Reynolds No. of 70,000 and Spin ration of 0.188 of greater than 0.24 and more preferably greater than 0.25. Moreover, the golf ball preferably has a coefficient of drag at a Reynolds No. of 70,000 and Spin Ratio of 0.188 of less than 0.27.

When numerical lower limits and numerical upper limits are set forth herein, it is contemplated that any combination of these values may be used.

All patents, publications, test procedures, and other references cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those of ordinary skill in the art without departing from the spirit and scope of the invention. For example, the dimples discussed herein are shown as circular dimples. However, it is understood that the present invention is intended to cover polygonal shaped dimples such as, for example, those disclosed in U.S. Pat. Nos. 7,722,484 and 7,867,109, which are incorporated by reference herein in their entirety. Accordingly, it is not intended that the scope of the claims appended hereto be limited to the examples and descriptions set forth herein, but rather that the claims be construed as encompassing all of the features of patentable novelty which reside in the present invention, including all features which would be treated as equivalents thereof by those of ordinary skill in the art to which the invention pertains.

What is claimed is:

1. A golf ball having an outer surface comprising a plurality of dimples covering greater than 70 percent of the outer surface, wherein at least 20 percent of the dimples incorporate directional surface texturing therein, wherein the directional surface texturing is comprised of a plurality of linear channels that are substantially parallel within the dimple.

2. A golf ball having an outer surface comprising a plurality of dimples covering greater than 70 percent of the outer surface, wherein at least 20 percent of the dimples incorporate directional surface texturing therein, wherein the directional surface texturing is comprised of a plurality of linear protrusions that are substantially parallel within the dimple.

3. The golf ball of claim 1, wherein the linear channels have a maximum channel depth of less than ¼ of a dimple depth.

4. The golf ball of claim 1, wherein a plurality of the linear channels have a channel length that is at least 5 times a width of the channel.

5. The golf ball of claim 1, wherein the linear channels have a channel width that is substantially similar to a channel depth.

6. The golf ball of claim 1, wherein the linear channels have a channel width that is greater than a channel depth and a length between adjacent linear channels is at least 2 times the channel width.

7. The golf ball of claim 2, wherein the linear protrusions have a maximum protrusion height of less than ¼ of a dimple depth.

8. The golf ball of claim 2, wherein a plurality of the linear protrusions have a protrusions length that is at least 5 times a width of the protrusion.

9. The golf ball of claim 2, wherein the linear protrusions have a protrusion width that is substantially similar to a protrusion height.

10. The golf ball of claim 2, wherein the linear protrusions have a protrusion width that is greater than a protrusion height and a length between adjacent linear protrusions is at least 2 times the protrusion width.

11. The golf ball of claim 1, wherein the linear channels within a dimple are disposed at an angle of between about 10 and 90 degrees with respect to the linear channels of an adjacent dimple.

12. The golf ball of claim 11, wherein linear channels are arranged at an angle of between about 30 and 90 degrees with respect to the linear channels of the adjacent dimple.

13. The golf ball of claim 2, wherein the linear protrusions within a dimple are disposed at an angle of between about 10 and 90 degrees with respect to the linear protrusions of an adjacent dimple.

14. The golf ball of claim 13, wherein linear protrusions are arranged at an angle of between about 30 and 90 degrees with respect to the linear protrusions of the adjacent dimple.

* * * * *